US009216605B2

(12) United States Patent
Degott et al.

(10) Patent No.: US 9,216,605 B2
(45) Date of Patent: Dec. 22, 2015

(54) SECURITY THREAD OR STRIPE COMPRISING ORIENTED MAGNETIC PARTICLES IN INK, AND METHOD AND MEANS FOR PRODUCING SAME

(75) Inventors: Pierre Degott, Crissier (CH); Claude-Alain Despland, Prilly (CH); Mathieu Schmid, Lausanne (CH); Gebhard Ritter, Lausanne (CH); Edgar Mueller, Lausanne (CH)

(73) Assignee: SICPA HOLDING SA, Prilly (CH)

( * ) Notice: Subject to any disclaimer, the term of this patent is extended or adjusted under 35 U.S.C. 154(b) by 268 days.

(21) Appl. No.: 13/582,203

(22) PCT Filed: Mar. 3, 2011

(86) PCT No.: PCT/EP2011/053148

§ 371 (c)(1),
(2), (4) Date: Oct. 25, 2012

(87) PCT Pub. No.: WO2011/107527

PCT Pub. Date: Sep. 9, 2011

(65) Prior Publication Data

US 2013/0033032 A1 Feb. 7, 2013

(30) Foreign Application Priority Data

Mar. 3, 2010 (WO) ..... PCT/IB2010/000435

(51) Int. Cl.
*B42D 25/369* (2014.01)
*B42D 25/40* (2014.01)
(Continued)

(52) U.S. Cl.
CPC ..... *B41M 3/14* (2013.01); *B42D 25/355* (2014.10); *D21H 21/42* (2013.01); *D21H 21/48* (2013.01);
(Continued)

(58) Field of Classification Search
CPC ..... B42D 2033/16; B42D 25/369
USPC ..... 283/72, 82
See application file for complete search history.

(56) References Cited

U.S. PATENT DOCUMENTS 964,014 A 7/1910 Gernaert
2,418,479 A 4/1947 Pratt et al.
(Continued)

FOREIGN PATENT DOCUMENTS

CN 2234116 8/1996
CN 2544370 4/2003
(Continued)

OTHER PUBLICATIONS

Chinese Office Action conducted in counterpart Chinese Appln. No. 201180011754.1 (Apr. 24, 2014) (w/ English language translation).
(Continued)

*Primary Examiner* — Kyle Grabowski
(74) *Attorney, Agent, or Firm* — Greenblum & Bernstein, P.L.C.

(57) ABSTRACT

The present invention concerns a security thread or stripe for the incorporation into or onto a value-document or currency substrate, as well as a method and means of making such thread or stripe. The thread or stripe comprises a plastic foil which carries a hardened coating comprising oriented magnetic or magnetizable pigment particles, the orientation of said pigment particles representing graphic information. Preferred are optically variable magnetic or magnetizable pigment particles. Said hardened coating may also be comprised between a first and a second plastic foil. Said graphic information is a repetitive seamless pattern of suitable repetition length, which is produced using a magnetic orienting cylinder having a corresponding repetitive seamless magnetic field pattern. A magnetic orienting cylinder and a process for process for producing such magnetic orienting cylinder are also disclosed. The process comprises the coating of a cylindrical support body with a polymer material comprising a high-coercivity permanent-magnetic powder as a filler material, and magnetizing or engraving the seamless outer cylinder surface to form on the cylinder a repetitive seamless magnetic field pattern.

9 Claims, 4 Drawing Sheets

(51) Int. Cl.

| | |
|---|---|
| ***B41M 3/14*** | (2006.01) |
| ***D21H 21/42*** | (2006.01) |
| ***D21H 21/48*** | (2006.01) |
| ***B42D 25/355*** | (2014.01) |
| *B41M 3/00* | (2006.01) |
| *B41M 7/00* | (2006.01) |

(52) U.S. Cl.

CPC ..... *B41M 3/006* (2013.01); *B41M 7/009* (2013.01); *B41M 7/0036* (2013.01); *B41M 7/0045* (2013.01); *B41M 7/0081* (2013.01); *B42D 2033/16* (2013.01); *B42D 2035/20* (2013.01); *B42D 2035/24* (2013.01)

(56) References Cited

U.S. PATENT DOCUMENTS

| | | | | |
|---|---|---|---|---|
| 2,570,856 | A | 10/1951 | Pratt et al. | |
| 3,676,273 | A | 7/1972 | Degott et al. | |
| 3,785,286 | A | 1/1974 | Giori | |
| 3,791,864 | A | 2/1974 | Steingroever | |
| 3,900,595 | A | 8/1975 | Giori | |
| 4,054,685 | A | 10/1977 | Giori | |
| 4,652,015 | A | 3/1987 | Crane | |
| 4,838,648 | A | 6/1989 | Phillips et al. | |
| 5,068,008 | A | 11/1991 | Crane | |
| 5,324,079 | A | 6/1994 | Kaule et al. | |
| 5,364,689 | A | 11/1994 | Kashiwagi et al. | |
| 5,486,022 | A | 1/1996 | Crane | |
| 6,103,361 | A | 8/2000 | Batzar et al. | |
| 6,199,911 | B1 * | 3/2001 | Isherwood et al. | 283/83 |
| 6,838,166 | B2 | 1/2005 | Phillips et al. | |
| 2002/0160194 | A1 | 10/2002 | Phillips et al. | |
| 2004/0009309 | A1 | 1/2004 | Raksha et al. | |
| 2004/0051297 | A1 | 3/2004 | Raksha et al. | |
| 2005/0106367 | A1 * | 5/2005 | Raksha et al. | 283/82 |
| 2008/0024847 | A1 * | 1/2008 | Kittler et al. | 283/82 |
| 2009/0200791 | A1 * | 8/2009 | Despland et al. | 283/72 |

FOREIGN PATENT DOCUMENTS

| | | |
|---|---|---|
| CN | 1832856 | 9/2006 |
| CN | 1852808 | 10/2006 |
| DE | 2006848 | 9/1971 |
| DE | 10 2007 043 052 | 3/2009 |
| EP | 0 021 350 | 11/1983 |
| EP | 0 185 396 | 8/1990 |
| EP | 0 303 725 | 6/1992 |
| EP | 0 319 157 | 7/1992 |
| EP | 710 508 | 5/1996 |
| EP | 0 635 431 | 4/1997 |
| EP | 686 675 | 2/1998 |
| EP | 0 608 078 | 5/1998 |
| EP | 0 518 740 | 5/1999 |
| EP | 1 498 545 | 1/2005 |
| FR | 1135734 | 11/1955 |
| JP | 56-000851 | 1/1981 |
| JP | 2001-501879 | 2/2001 |
| JP | 2001-503819 | 3/2001 |
| JP | 2004-198447 | 7/2004 |
| JP | 2007-527329 | 9/2007 |
| JP | 2008-529823 | 8/2008 |
| JP | 2009-000908 | 1/2009 |
| JP | 2009-190331 | 8/2009 |
| JP | 2009-536974 | 10/2009 |
| JP | 2009-541873 | 11/2009 |
| WO | 90/08367 | 7/1990 |
| WO | 92/11142 | 7/1992 |
| WO | 96/04143 | 2/1996 |
| WO | 96/39685 | 12/1996 |
| WO | 98/19866 | 5/1998 |
| WO | 02/073250 | 9/2002 |
| WO | 02/090002 | 11/2002 |
| WO | 03/000801 | 1/2003 |
| WO | 2005/002866 | 1/2005 |
| WO | 2007/131833 | 11/2007 |
| WO | 2008/009569 | 1/2008 |
| WO | 2008/046702 | 4/2008 |

OTHER PUBLICATIONS

Gokturk et al., "Electic and Magnetic Properties of Low Density Polyethylene Filled with Nickel Powders, Fibers and Flakes," ANTEC '92, Annual Technical Conference of the Society of Plastics Engineers, Detroit, MI, pp. 491-494 (1992).

Gokturk et al., "Effects of Particle Shape and Size Distributions on the Electrical and Magnetic Properties of Nickel/Polyethylene Composites," *Journal of Applied Polymer Science*, vol. 50, pp. 1891-1901 (1993).

Stäblein, "Hard Ferrites and Plastoferrites," *Ferromagnetic Materials*, vol. 3, ed. E.P. Wohlfarth, North-Holland Publishing Co., Chapt. 7, pp. 441-602 (1982).

Sakai et al., "Plastics Magnet Manufacturing Process: Mixing, Kneading, and Injection Molding," *Intern. Polymer Processing VI*, pp. 26-34 (1991).

Japan Office Action conducted in counterpart Japan Appln. No. 2012-555419 (Oct. 21, 2014) (w/ English language translation).

Eurasian Office Action conducted in counterpart Eurasian Appln. No. 201290831 (Jan. 19, 2015) (w/ English language translation).

Japan Office Action conducted in counterpart Japan Appln. No. 2012-555419 (Jun. 9, 2015) (w/ English language translation).

* cited by examiner

B

A

SECURITY THREAD OR STRIPE COMPRISING ORIENTED MAGNETIC PARTICLES IN INK, AND METHOD AND MEANS FOR PRODUCING SAME

FIELD OF THE INVENTION

The present invention is in the field of security threads or stripes, to be incorporated into or onto value-document or currency substrates. It discloses a security thread or stripe comprising features implemented through a particular orientation of magnetic or magnetizable pigment particles, in particular optically variable pigment particles, in a coating comprised on said thread or stripe, as well as a method and a device for producing such thread or stripe.

TECHNICAL BACKGROUND

Security threads embedded in the substrate are known to the skilled person as an efficient means for the protection of security documents and banknotes against imitation. Reference is made to U.S. Pat. No. 0,964,014; U.S. Pat. No. 4,652,015; U.S. Pat. No. 5,068,008; U.S. Pat. No. 5,324,079; WO 90/08367; WO 92/11142; WO 96/04143; WO 96/39685; WO 98/19866; EP-A 0 021 350; EP-A 0 185 396; EP-A 0 303 725; EP-A 0 319 157; EP-A 0 518 140; EP-A 0 608 078; EP-A 0 635 431; and EP-A 1 498 545 as well as the references cited therein.

A security thread is a metal- or plastic-filament, which is incorporated during the manufacturing process into the substrate serving for printing security documents or banknotes. The security thread may hereby be completely embedded within the substrate sheet, or it may be partly embedded and partly exposed at the surface of the substrate ("window-thread"), or it may even be affixed to the surface of the substrate or bridge two separate parts of the substrate sheet; such threads are also called stripes.

A security thread or stripe may, and does in general, carry particular security elements, serving for the public and/or machine-authentication of the security document, in particular for banknotes. Suitable security elements for such purpose are e.g. a metallization, a luminescent compound (incorporated into, or printed onto the thread or stripe), a micro-text, a magnetic feature, etc.

Due to the technical constraints of industrial manufacturing, the security thread or stripe must be incorporated from a reel into an endless sheet of substrate material, such as currency paper, being several hundred meters in length. Such thread or stripe is generally produced through a corresponding slicing of a web of a particularly treated (i.e. metallized, imprinted, laminated, etc.) plastic foil (such as a mono- or bi-oriented polypropylene (PP), a polyvinylchloride (PVC), or a polyethylene-terephthalate (PET) foil), to yield the required reels of security thread or stripe.

In a common embodiment, said plastic foil is metallized and/or imprinted on a single side. The metallization may furthermore be present in the form of indicia in positive or negative writing. In a more sophisticated embodiment, said plastic foil is a laminated structure, consisting of two foils which are laminated together, enclosing security elements such as a printed feature and/or a metallization, between two plastic foils.

Optically variable magnetic pigment (OVMP®) and optically variable magnetic inks (OVMI®) comprising OVMP® are known to the skilled person from e.g. U.S. Pat. No. 4,838,648; WO 02/073250; EP 686 675; WO 03/00801; U.S. Pat. No. 6,838,166; and WO 2007/131833. Such inks can be applied or printed in the form of plain coatings (i.e. covering a whole surface) or in the form of structured coatings (i.e. indicia).

The optically variable pigment particles in an optically variable magnetic coating can be oriented after printing, while the coating is still "wet", i.e. unhardened, through the application of an appropriate unstructured or structured magnetic field, and then fixed in their respective positions and orientations through a hardening of the coating composition on the substrate. Materials and technology for the orienting of magnetic or magnetisable particles in a coating composition, and corresponding combined printing/magnetic orienting processes have been disclosed in U.S. Pat. No. 2,418,479; U.S. Pat. No. 2,570,856; U.S. Pat. No. 3,791,864; DE 2006848-A; U.S. Pat. No. 3,676,273; U.S. Pat. No. 5,364,689; U.S. Pat. No. 6,103,361; US 2004/0051297; US 2004/0009309; EP-A-710508, WO 02/090002; WO 03/000801; WO 2005/002866, and US 2002/0160194, as well as WO 2008/046702 of the same applicant.

Items comprising magnetically oriented particles in a hardened coating on a transparent or opaque substrate are known in the art, e.g. from WO 2008/009569. However, a particular technical problem arises in the case of security threads or stripes, in that they must i) display a seamless repetitive pattern in their elongated direction, and ii) the repetition length (period) of said pattern must be smaller than the width, preferably smaller than the half width of the banknote or the security document into which they are incorporated.

These requirements assure that i) there is no need for cutting away parts of the security document substrate, nor for aligning the banknote or security document printing with the information present on the thread or stripe, because the latter is continuous (without jumps) along the security thread or stripe, and that ii) at least one whole period of the information present on the thread or stripe is actually present on/in each banknote or security document, allowing for an unambiguous authentication of the latter.

These requirements have not been previously resolved for magnetically oriented particles in a hardened coating on a substrate.

DESCRIPTION OF THE INVENTION

The thread or stripe according to the present invention, preferably for the incorporation into or onto a value document or currency substrate, comprises a plastic foil which carries a hardened coating comprising oriented magnetic or magnetizable pigment particles, the orientation of said pigment particles representing graphic information, and the security thread or stripe being characterized in that said graphic information is a repetitive seamless pattern of suitable repetition length.

"Hardened" in the context of the present disclosure means that the optically variable magnetic or magnetizable pigment particles are fixed in their respective positions and orientations within the coating.

A "suitable repetition length" (period) means one that is smaller than the width, preferably smaller than the half width of the document into which the thread or stripe is to be incorporated.

Preferred magnetic or magnetizable pigment particles for embodying the present inventions are plate- or needle-shaped particles, because they orient well in a magnetic field and show a pronounced change in optical aspect as a function of their orientation in the coating.

Even more preferable are optical interference pigments, which exhibit a variation of reflection or transmission color as a function of their orientation in the coating.

The most preferred pigment particles for embodying the present invention are optically variable magnetic thin-layer interference pigments of the A/D/M/D/A 5-layer type, such as disclosed in U.S. Pat. No. 4,838,648, and of the A/D/R/M/R/D/A 7-layer type, such as disclosed in WO 02/073250. Herein, A stands for an absorber layer, typically a chromium layer; D stands for a dielectric layer, typically magnesium fluoride ($MgF_2$) or silicon dioxide ($SiO_2$); M stands for a magnetic layer, typically nickel (Ni) or iron (Fe) or cobalt (Co) or one of their alloys, and R stands for a reflector layer, typically aluminum (Al).

In the context of the present disclosure, the term "magnetic" refers to a material which is itself a source of a magnetic field. The term "magnetizable" refers to a material which reacts to a magnetic field in the sense of ferro- or ferri-magnetism, without being a source of it.

Oriented magnetic or magnetizable pigment (OVMP) particles, in the context of the present description, means pigment particles which are present in the coating in an orientation which is different from the one they would adopt as the result of a simple printing process.

"Graphic information" means indicia, patterns, images, and any other type of information which can be visually identified.

According to the present invention, graphic information is embodied in the coating through the orienting of the magnetic or magnetizable pigment particles comprised in the coating.

In a preferred embodiment of the present invention, the hardened coating is a structured coating in the form of indicia, and is applied using an ink and a corresponding printing process.

The magnetic-orientation-borne graphic information is generally different from the printed indicia of the structured coating; however it could also be chosen the same.

It is thus possible, according to the present invention, to impart on the security thread or stripe two different security elements, i.e. the printed visible indicia and the magnetic-orientation-borne graphic information, in a single pass on the printing machine, using a single printing ink, which increases the security level of the security thread or stripe whilst maintaining enhanced production efficiency.

The visible, magnetic-orientation-borne graphic information is also machine-readable, because the particularly disposed magnetic or magnetizable particles in the printed and hardened coating composition produce or interact with magnetic fields, and their local repartition and orientation can thus be detected and exploited by corresponding equipment.

An essential feature of the security thread or stripe according to the present invention is that the magnetic-orientation-borne graphic information and, if present, the printed visible indicia, are present as an seamless repetitive pattern of suitable repetition length (period) along the extended dimension of the security thread or stripe.

Given the constraints imposed by the conditions of banknote manufacturing (i.e. the substrate manufacturing and the printing) and use (i.e. the authentication of the security thread or stripe in automatic banking machines), security threads or stripes must be incorporated lengthwise into the substrate web, but should appear across the width of the banknote, which is generally smaller than to cm, and typically of the order of 7 cm. The period of the repetitive pattern should thus not exceed 7 cm, preferably not exceed 3.5 cm, and even more preferably not exceed 2 cm.

The seamless imprinting of plastic foils with repetitive patterns of optically variable magnetic ink under the constraint of such small repetition lengths requires particular production (i.e. printing) means and techniques.

It was found that rotogravure (gravure) printing using a specially engraved, seamless gravure cylinder is one of the suitable printing techniques for properly transferring an ink liquid containing magnetic or magnetizable pigment particles onto a flat plastic substrate. The rotogravure cells in the gravure cylinder must noteworthy be large enough such as to cope with the extended size of the magnetic or magnetizable pigment particles, which in particular can be flakes, having a diameter comprised between 5 and 50 micrometers and a thickness of the order of 1 micrometer. A cell size of at least twice the mean diameter of the pigment particles is typically used.

Screen-printing using a seamless rotary screen (such as obtainable from Stork Prints BV, Boxmeer, Netherlands) was found to be another suitable printing technique for the imprinting of plastic foils with seamless repetitive patterns of an ink containing magnetic or magnetizable pigment particles under the constraint of small repetition lengths. Also here, a screen mesh size of at least twice the mean diameter of the pigment particles is typically used.

As a further process, flexographic printing using Anilox roller/doctor blade inking can be used. The Anilox roller has rotogravure cells, which meter the ink liquid onto the endless flexographic relief plate, which is a flexible typographic printing surface which transfers the ink to the substrate to be imprinted. Flexographic printing performs well if the pigment particles are not large in size, and less well in case of pronounced plate-like pigment particles, which do not easily transfer from one surface to another. For the Anilox roller, a cell size of at least twice the mean diameter of the pigment particles is typically used.

In all cases, the printing surface must be structured such as to represent an seamless repetitive pattern; in other words, the circumference of the printing cylinder or of the endless flexographic relief plate must be an exact multiple of the repetition length (period) of the repetitive pattern to be printed.

In a preferred embodiment, the hardened coating comprising optically variable magnetic or magnetizable pigment particles is associated with a colored, dark, or metallized background coating. Said background coating may be applied or printed in a previous, following, or separate step.

If the security thread or stripe is to be viewed through the plastic foil, the background coating must be applied as a second coating, after the application (and hardening) of the optically variable magnetic ink.

Further coatings may be applied as a function of the technical and esthetic needs, such as pigmented coatings to provide color and/or opacity, or adhesive coatings, to fix the thread or stripe into or onto the value document or banknote substrate.

According to a further particular embodiment of the present invention, the security thread or stripe is a laminated thread or stripe, comprising a hardened coating, produced with an ink comprising optically variable magnetic or magnetizable pigment particles, which is comprised between a first and a second plastic foil.

In still a further embodiment, the security thread or stripe according to the present invention is a laminated thread or stripe obtained by laminating in register a first plastic foil carrying a first imprinting onto a second plastic foil carrying a second imprinting which is complementary to the first imprinting.

Laminating together in register two foils having mutually complementary imprintings requires high-precision printing and laminating equipment, which provides enhanced counterfeit resistance to the so produced thread or stripe.

The security thread or stripe according to the present invention, comprising the hardened coating produced with an ink comprising magnetic or magnetizable pigment particles, may also comprise additional security materials selected from the group consisting of the luminescent dyes and pigments, of the infrared-absorbing dyes and pigments, as well as of the metallic, magnetic, and interference pigments. Said additional security materials may furthermore be comprised in said same coating or in at least one separate coating layer.

The security thread or stripe according to the present invention may further comprise a layer of micro-lenses or a holographic layer, which latter may be a volume hologram or a metallized, demetallized, or partially demetallized (indicia) surface hologram.

The security thread or stripe according to the present invention may comprise an adhesive coating as known in the art on at least one of its surfaces, to provide adherence to the security substrate. Thermo-activateable adhesives, which glue to the paper fibers at the end of the paper dewatering and drying process, are typically used to this purpose.

The preferred security thread or stripe according to the present invention has a width comprised in between 0.5 mm and 30 mm. It is obtained by slicing the web of imprinted, coated and if the case laminated plastic foil into threads of appropriate width and winding them onto reels.

Disclosed is further a method for producing a security thread or stripe for the incorporation into a value document or a currency substrate, comprising the steps of a) coating a plastic foil with a coating composition comprising magnetic or magnetizable pigment particles;
b) orienting the magnetic or magnetizable pigment particles in the coating on the plastic foil through the application of a correspondingly structured magnetic field, such that the orientation of said pigment particles represents graphic information;
c) hardening the coating comprising the oriented magnetic or magnetizable pigment particles, such as to fix the optically variable magnetic or magnetizable pigment particles in their respective positions and orientations;
y) optionally applying an adhesive coating on at least one surface of the plastic foil;
z) slicing the plastic foil carrying said hardened coating comprising oriented optically variable magnetic or magnetizable pigment particles into threads or stripes;

the method being characterized in that said graphic information is produced using a magnetic orienting cylinder having a repetitive seamless magnetic field pattern of suitable repetition length.

Preferred magnetic or magnetizable pigment particles to be comprised in the coating composition are selected from the plate- or needle-shaped particles; particularly preferred are magnetic optical interference pigments, which exhibit a variation of reflection or transmission color as a function of their orientation in the coating; and most preferred are optically variable magnetic thin-layer interference pigments of the 5-layer type, such as disclosed in U.S. Pat. No. 4,838,648, and of the 7-layer type, such as disclosed in WO 02/073250; see above.

The plastic foil is preferably a polyethylene-terephthalate (PET, polyester) foil. However, other plastic materials can be used as well, such as mono- or bi-oriented polypropylene (PP), polyvinylchloride (PVC), or form-stable varieties of polyethylene (PE)).

Imprinting the plastic foil with a coating composition comprising magnetic or magnetizable pigment particles, followed by orienting said pigment particles in the coating through the application of a correspondingly structured magnetic field and hardening the printed and "oriented" ink can be performed in a one-step industrial operation, capable to impart two independent "layers of information" (printed indicia and magnetic-orientation-borne graphic information) using a single ink.

The method may comprise the application of more than one printed layers. In a preferred embodiment, the method comprises the additional step of:

d) applying a colored, dark, or metallized background coating onto the hardened coating of step c) comprising the oriented optically variable magnetic or magnetizable pigment particles.

Said background coating can be applied by a variety of coating processes known to the skilled in the art, such as imprinting with an ink comprising colored or dark pigments or dyes, or by high-vacuum coating with metals (preferably aluminum); such high-vacuum coating step may optionally be followed by a selective demetallization step (e.g. according to Crane, U.S. Pat. No. 4,652,015), so as to produce indicia in the metal coating.

Additional security materials selected from the group consisting of the luminescent dyes and pigments, of the infrared-absorbing dyes and pigments, as well as of the metallic, magnetic, and interference pigments can be applied, either in said same coating or in at least one separate coating layer.

A layer of micro-lenses or a holographic layer, which may be a volume hologram or a metallized, demetallized, or partially demetallized (indicia) surface hologram can also be applied.

An adhesive coating as known in the art may be applied on at least one of the surfaces of the plastic foil, to provide adherence to the security substrate upon incorporation of the thread or strip into or onto the latter.

The method may further comprise the alternative or additional step of e) laminating a second plastic foil onto the coated plastic foil, to produce a laminated structure wherein said hardened coating comprising oriented optically variable magnetic or magnetizable pigment particles is comprised between a first and a second plastic foil.

Step e) may be carried out either in place of step d), or, alternatively, following step d).

The second plastic foil may carry a coating on the lamination surface, such as to facilitate the laminating operation. In particular, said coating may be a colored, dark, or metallized background coating.

In a preferred embodiment of the method, the second plastic foil carries a second imprinting, which is complementary to the first imprinting on the first plastic foil. Complementary means that the second imprinting completes the first, such that both imprintings only together display the full information. The separate printing of complementary indicia on two foils, which are to be laminated together in exact register, requires high-precision printing and laminating equipment, which results in enhanced counterfeit resistance of the so produced threads or stripes.

In a preferred method according to the present invention, the imprinting of the first plastic foil with an ink comprising magnetic or magnetizable pigment particles is performed with a printing process selected from the group consisting of rotogravure printing using a seamless engraved printing cylinder, screen-printing using a seamless rotary screen, and flexographic printing using an Anilox roller/doctor blade inking unit, wherein the printing surface represents an seamless repetitive pattern, i.e. the circumference of the printing cylinder or of the endless flexographic relief plate is an exact multiple of the repetition length (period) of the repetitive pattern to be printed.

In a preferred method according to the present invention, the orienting of the magnetic or magnetizable pigment particles in the imprinted coating, such that the orientation of said pigment particles represents graphic information, is carried out using a magnetic orienting cylinder whose outer surface is an engraved permanent-magnetic plate, such as disclosed in WO 2005/002866 and in WO 2008/046702.

In a preferred method according to the present invention, the hardening of the imprinted coating on the substrate is carried out by a method chosen from physical drying by evaporation of solvent, and, most preferably, curing by irradiation with electron beam or with UV-light. Radiation-curing has the advantage of an almost instantaneous solidification of the ink, preventing the oriented magnetic particles from rearranging in the ink.

Particularly preferred is curing by direct UV-irradiation on the magnetic orienting cylinder, such that the orienting of the magnetic or magnetizable pigment particles in the coating and the initiating of the hardening of the coating occur concomitantly. After UV-irradiation, the coating solidifies in less than one second. Direct UV-irradiation on the magnetic orienting cylinder ensures thus a maximum retention of the graphic information imparted in the magnetic orienting step.

In the last step of the method (step z)), the web of foil so obtained is finally sliced into security threads or stripes, the threads or stripes having a width comprised in between 0.5 mm and 30 mm, and the security threads or stripes are wound onto reels for further use.

The security threads or stripes can be incorporated into or applied onto any type of substrates to be protected against counterfeit, in particular paper and polymer substrates used to make currency, value-documents, ID-documents, transportation tickets, or tax stamps.

Disclosed is further a device for magnetically orienting the magnetic or magnetizable pigment particles in the imprinted coating on the plastic foil used to make security threads or stripes.

The device for magnetically orienting the magnetic or magnetizable pigment particles in the imprinted coating is a cylinder having a magnetized outer surface, wherein the magnetization is structured such as to represent a repetitive seamless pattern of suitable repetition length; in other words, the circumference of the cylinder is an exact multiple of the period (repetition length) of the repetitive pattern.

The magnetic orienting cylinder can be produced by wrapping a flexible, magnetically inscribed, permanent-magnetic plate (e.g. of "Plastoferrite") around a cylindrical support body and fixing it in such position, so as to result in a seamless repetitive magnetization pattern around the circumference of the magnetic orienting cylinder. The magnetized permanent-magnetic plate may be an engraved permanent magnetic plate, such as disclosed in WO 2005/002866 and in WO 2008/046702.

In a preferred embodiment, the magnetic orienting cylinder is seamless coated with a "plastic magnet" coating, in which the seamless repetitive magnetization pattern is inscribed. Alternatively the outer cylinder surface of the seamless coated cylinder can be engraved with a seamless repetitive pattern, and magnetized as disclosed in WO 2005/002866.

Such seamless coated magnetic orienting cylinder turns out to be of advantage for producing the security thread or stripe of the present invention when combined with a corresponding seamless rotogravure cylinder or a seamless rotary screen cylinder operated in register with the magnetic orienting cylinder, because of the mechanical stability of the seamless coating and the hereof resulting possibility to print and orient at high speed.

The magnetic orienting cylinder according to the invention may additionally comprise permanent magnets or electromagnets disposed inside the cylindrical support body, in order to produce the effects disclosed in WO 2008/046702 of the same applicant. Particularly preferred are magnet arrangements which are mechanically hold in positions against the inherent magnetic forces working between them.

Further disclosed is a process for producing a seamless coated magnetic orienting cylinder; the process being characterized by the steps of a) coating a cylindrical support body with a polymer material comprising a high-coercivity permanent-magnetic powder as a filler material and hardening the polymer material, so as to obtain a seamless coated cylinder;
b) optionally rectifying the outer surface of the coated cylinder to obtain a standard cylinder diameter;
c) magnetizing the outer cylinder surface of step a) or step b) to inscribe on the cylinder a repetitive seamless magnetic field pattern.

Said coating and hardening can be performed either by applying a hot, molten thermoplastic composition and cooling down to solidify the composition, or by applying a Plastisol precursor composition and heat-curing so as to form and solidify the Plastisol.

The polymer material can be chosen from the thermoplastic materials which are commonly used to make "plastic magnets", such as polyethylene or a polyamide. Low Density Poly-Ethylene (LDPE) is hot-meltable and can be used to formulate plastic magnet compositions (H. S. Gokturk et al. ANTEC '92; *Annual Technical Conference of the Society of Plastics Engineers*, Detroit, Mich., May 1992; pages 491-494; *Journal of Applied Polymer Science*, Vol 50, 1891-1901, (1993)). Plastic and rubber magnets were first disclosed in French Patent FR1135734 (M. J. Dedek; 1955).

JP56000851A2 (Komeno Hiroshi; 1981) discloses a plastic magnet composition on the basis of thermoplastic polyamide resin. See also H. Stäblein, "Hard Ferrites and Plastoferrites", in *Ferromagnetic Materials*, Vol. 3, ed. E. P. Wohlfarth, North-Holland Publishing company, 1982, chapter 7, pages 441-602.

The coating of the cylindrical support body can then be performed, e.g. in analogy to T. Sakai et al., *Intern. Polymer Processing,* 6, 26-34 (1991), who disclose a plastics magnet manufacturing process, relying on Nylon 6 as thermoplastic binder and strontium hexaferrite ($SrO*6Fe_2O_3$) powder of 1.1-1.2 micrometer particle size as a high-coercivity permanent-magnetic filler material.

Alternatively, the coating of the cylindrical support body can be performed according to U.S. Pat. No. 3,785,286, U.S. Pat. No. 3,900,595, and U.S. Pat. No. 4,054,685, who disclose a Plastisol coating process, using polyvinyl chloride (PVC) in conjunction with one or more plasticisers and a stabilizer. The Plastisol composition, including the permanent-magnetic filler material, is formulated and applied onto the cylindrical support body at temperatures of 40° C. to 50° C., and hardened at temperatures of 200° C. to 250° C. The Plastisol coating is applied in several layers, each having a thickness between 0.3 and 1 mm, up to a total thickness of 2 to 3.5 mm.

Examples of high-coercivity permanent-magnetic powders, which are useful as filler materials, are the "hexaferrites" of the formula $MFe_{12}O_{19}$, such as strontium hexaferrite ($SrO*6Fe_2O_3$) or barium hexaferrite ($BaO*6Fe_2O_3$), and the "hard ferrites" of the formula $MFe_2O_4$, such as cobalt ferrite ($CoFe_2O_4$) or magnetite ($Fe_3O_4$), wherein M is a bivalent metal ion, as well as their isostructural substitution derivatives; further the samarium-cobalt alloys, and the rare-earth-iron-boron alloys ($RE_2Fe_{14}B$, e.g. "neodymium magnets" $Nd_2Fe_{14}B$), wherein RE is a trivalent rare earth ion or a mixture of trivalent rare earth ions.

Preferably, the high-coercivity permanent-magnetic powders are used in the composition in a demagnetized state, such as to prevent a magnetic agglomeration of the magnetic powder particles. The demagnetization ("degaussing") of magnetic materials is an operation known to the skilled person. Preferably, a magnetization is only applied after the composition is in place and hardened.

The optional rectification step is a simple mechanical ablation operation on a lath. It serves to establish precise mechanical dimension, in order to provide that the circumference of the cylinder is an exact multiple of the period (repetition length) of the repetitive magnetization pattern.

The structured magnetization of the cylinder surface can be performed as known to the skilled person, e.g. by applying a magnetic stylus according to U.S. Pat. No. 3,011,436 (Berry) or in electromagnetic and mechanical analogy to Berry's disclosure, by inscribing the required repetitive magnetization pattern with a mechanically driven electromagnetic stylus.

In a particularly preferred embodiment of the process, step c comprises an engraving step:

c) engraving the outer surface of the coated cylinder of step a) or step b) with a repetitive seamless pattern, and magnetizing the cylinder.

The engraving and magnetization of the outer cylinder surface can be performed as disclosed in WO 2005/002866. In particular, the engraving can be performed using ablative tools selected from the group comprising mechanical ablation tools, gaseous or liquid jet ablation tools, and laser ablation tools.

The magnetization can be applied before or after the engraving step. Magnetic fields orthogonal to the cylinder surface, as well as fields in oblique directions with respect to the cylinder surface, or even in directions within the cylinder surface may be applied.

The magnetization of the outer surface of the cylinder may furthermore be combined with the disposition of magnets inside the cylindrical support body, as disclosed in WO 2008/046702; said magnets may further be permanent magnets or electromagnets.

The invention is now further explained with reference to the figures and to exemplary embodiments.

DESCRIPTION OF THE FIGURES

In FIG. 1 to FIG. 4, the different layers are as follows:

1*a*: Polyethylene terephthalate (PET) film

2*a*: Ink layer containing magnetically oriented pigments

3*a*: Black ink layer

4*a*: White ink layer

5*a, c*: Thermo-adhesive layers

5*b*: Lamination-adhesive layer

6*a*: Invisible fluorescent ink layer

Figure 5:
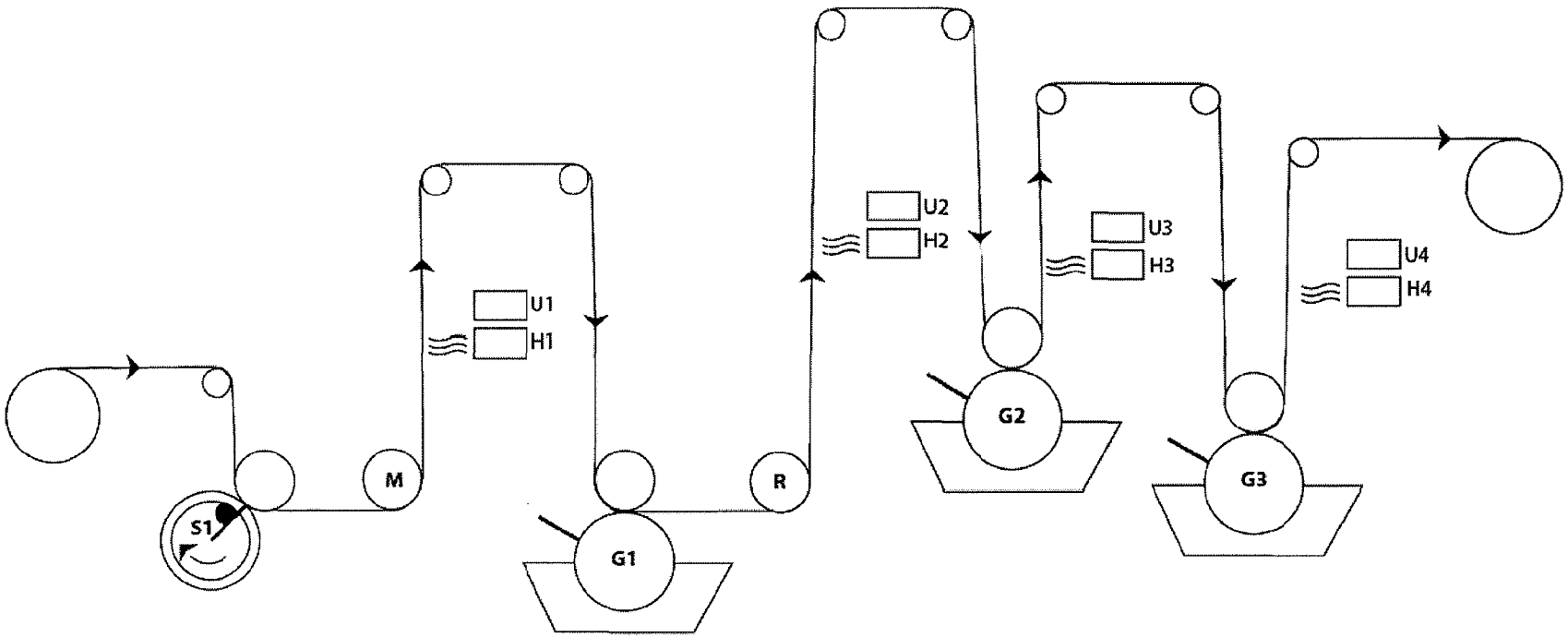

FIG. 5: Schematic view of a dedicated foil web printing press for producing security threads and stripes according to the present invention.

Description of the different machine parts:

S1: Screen printing unit

G1, 2, 3: Gravure printing units

M, R: Magnetic orienting units (cylinders)

The magnetic orienting can be produced on one or the other of these cylinders, depending upon which printing unit is used for applying the ink comprising the magnetic or magnetizable particles.

H1, 2, 3, 4: Hot-air dryer units

U1, 2, 3, 4: UV dryer units

Figure 6:
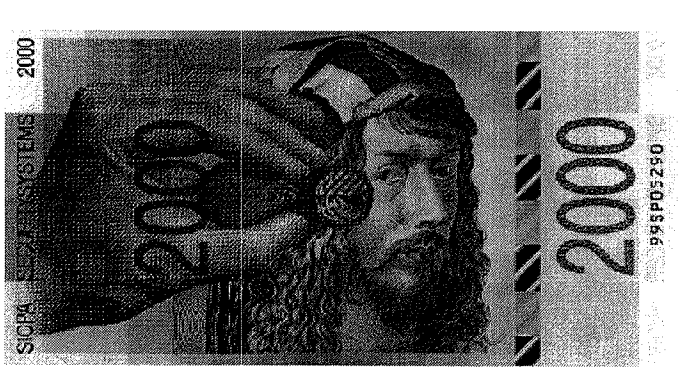
Figure 6:
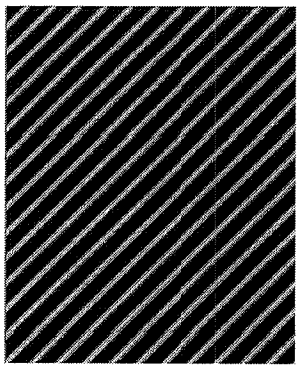

FIG. 6A: Face view of a sample of the web produced in example 1 (before the slicing process)

FIG. 6B: Banknote specimen printed on a substrate carrying a window thread produced according to example 1

EXAMPLE 1

Figure 1:
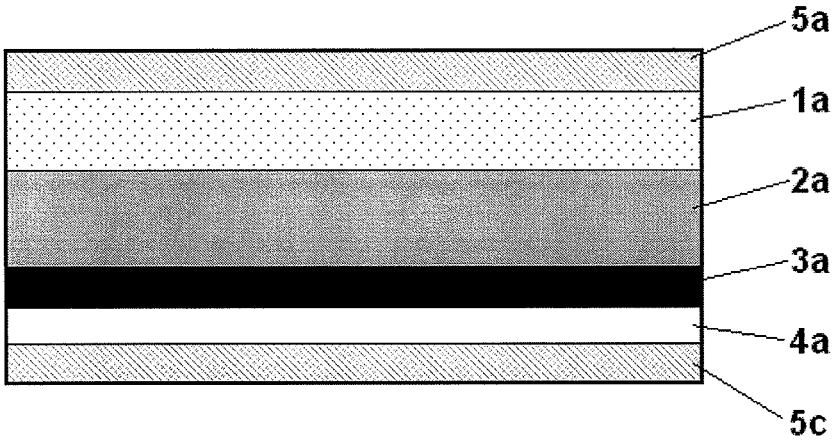
FIG. 1: schematically depicts the cross-section of a first embodiment of a security thread or foil according to the present invention.

In the first example, the description of an optically variable magnetic security thread according to the present invention is given. The security thread has a schematic cross-section as described in FIG. 1. It can be produced by imprinting a plastic foil on a dedicated printing press, such as is schematically depicted in FIG. 5, combining gravure (G1, G2 and G3), screen (S1) printing, and magnetic orienting (M, R) units, and slicing the imprinted foil, according to the following steps:

a) A 15 μm thick PET film (1*a*) is imprinted on the screen printing unit (S1) with a UV curing ink containing optically variable magnetic pigments (layer 2*a*), as described in Example 2 (base formula) of WO 2007/131833. The screen is chosen such as to deposit a dry ink layer of typically 18 μm. The freshly printed ("wet") ink layer is exposed to the magnetic fields of the magnetic orientation cylinder (M). This cylinder has a 2 mm thick magnetic coating of polyethylene comprising 75 wt % of strontium hexaferrite. The surface of this magnetic coating is magnetized with a helical pattern of alternating polarities in the form of 1.5 mm wide tracks; the distance between tracks of same polarity being 3 mm, and the angle of the tracks with respect to the printing direction being of 45°. The optically variable magnetic pigments comprised in the printed ink are hereby oriented and a specific graphic information pattern is produced in this layer, such as shown in FIG. 6A. The ink is hardened as the web passes under the hot air (H1) and the UV (U1) dryer units.

b) A solvent based black ink (layer 3*a*) layer is then applied over the oriented and cured magnetic ink layer, using the following gravure printing unit G1. The ink layer is dried with the hot air dryer unit H2. The gravure cylinder is chosen such as to deposit a dried ink layer of typically 3 μm.

c) A solvent based white ink (layer 4*a*) is then applied over the black ink on the following gravure printing unit G2 and dried with the hot air dryer unit H3. The gravure cylinder is chosen in such a way as to deposit a dried ink layer of typically 3 μm.

d) A solvent based thermo-adhesive layer (5*c*) is then applied over the white ink on the following gravure printing unit G3 and dried with the hot air dryer unit H4.

The gravure cylinder is chosen in such a way as to deposit an adhesive layer of typically 4 μm. Care must be taken to ensure that the temperature of the web stays below the activation temperature of the adhesive.

e) In an additional pass in the press, a solvent based thermo-adhesive layer (5*a*) is applied on the other side of the PET film, using the gravure printing unit G3, and dried with the hot air dryer unit H4. The gravure cylinder is chosen in such a way as to deposit an adhesive layer of typically 4 μm. Care must be taken to ensure that the temperature of the web stays below the activation temperature of the adhesive.

f) The web is finally sliced into 3 mm wide threads, which are put onto reels for incorporation as window-thread into cotton based security paper (during the paper production process).

FIG. 6B shows a banknote specimen printed on a substrate carrying a window thread produced as described above.

EXAMPLE 2

Figure 2:
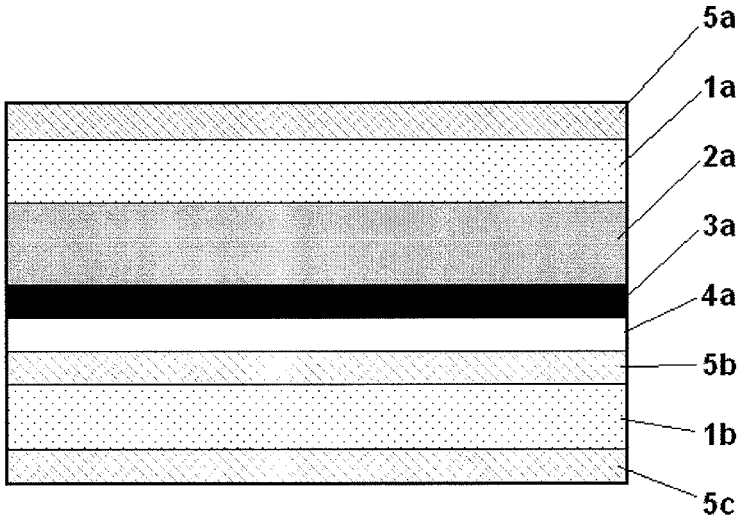
FIG. 2: schematically depicts the cross-section of a second embodiment of a security thread or foil according to the present invention.

In the second example, the description of a security thread comprising an optically variable magnetic ink layer between two plastic foils is given. The security thread has a schematic cross-section as depicted in FIG. 2. The first part, composed of layers 1*a* to 4*a*, is produced according to the sequence a) to c) described in the previous example, except that a 12 μm thick PET film (1*a*) is used in place of the 15 μm film, to reduce the overall thickness of the final structure. The first part consisting of layers 1*a* to 4*a* is then laminated onto a second part consisting of an 8 μm thick PET film (1*b*) coated with a 4 μm thick lamination adhesive layer (5*b*). This lamination adhesive is a solvent based polyurethane system deposited onto the second PET film (1*b*) by gravure printing. In the final step, thermo-adhesive layers (5*a* and 5*c*) are applied on each side of the laminate by gravure printing (dry deposit of typically 4 μm).

The web is finally sliced into 3 mm wide threads, which are put onto reels, to be incorporated as window-thread during the production of cotton based security paper.

EXAMPLE 3

Figure 3:
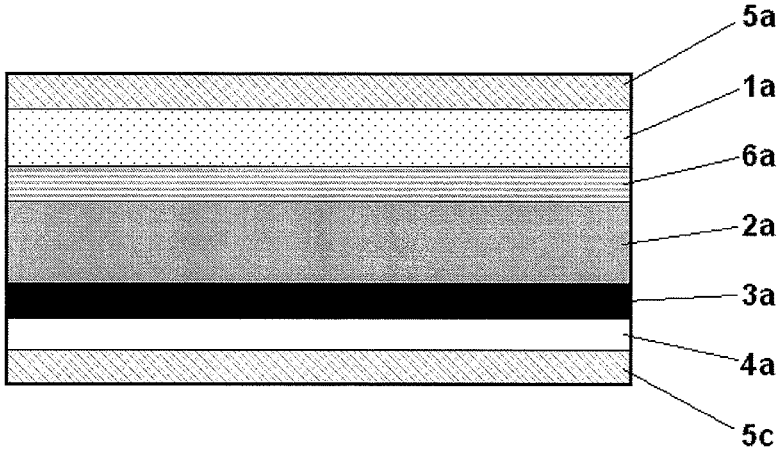
FIG. 3: schematically depicts the cross-section of a third embodiment of a security thread or foil according to the present invention.

In the third example, the description of an optically variable magnetic security thread combining luminescence properties is given. The security thread has a schematic cross-section as depicted in FIG. 3. The security thread is produced in the same was as the one described in Example 1, except that a fluorescent solvent based gravure ink layer (6*a*) is applied first onto the PET film. The gravure cylinder is chosen such as to deposit a dried ink layer of typically 2 μm. The fluorescent pigment must be chosen such as to withstand the subsequent thermal treatment occurring during the incorporation of the thread into the security substrate. Its light scattering should further be low when incorporated into the ink matrix, for not to negatively interfere with the optical effect layer (2*a*). A solvent based ink formulation comprising 3% of Lumilux CD 382 (Honeywell), Polyurethane (PU) and polyvinylbutyral (PVB) resins fulfills these requirements.

The web is finally sliced into 3 mm wide threads, which is put onto reels for incorporation as a window-thread during the production of cotton based security paper. Further to the optical color-shifting effect, this thread shows a yellow luminescence under a 366 nm UV excitation.

EXAMPLE 4

Figure 4:
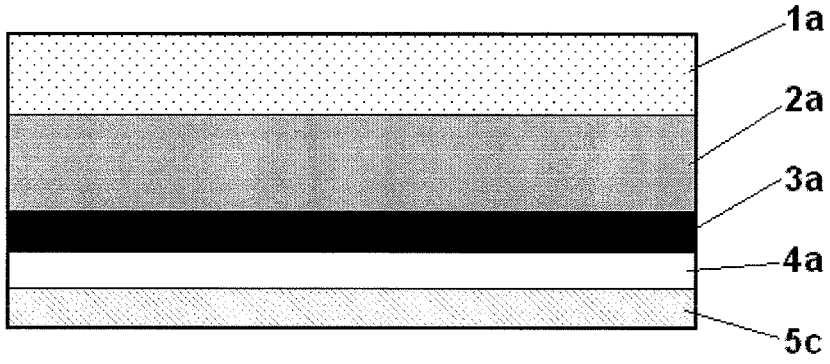
FIG. 4: schematically depicts the cross-section of a fourth embodiment of a security thread or foil according to the present invention.

In the fourth example, the description of an optically variable magnetic foil according to the present invention is given. The security foil has a schematic cross-section as depicted in FIG. 4. The foil is produced according to steps a) to d) described in Example 1. The web is finally sliced into 8 mm wide foil stripes, which can be hot-stamped onto reels of security substrate.

EXAMPLE 5

This example describes the same thread as described in example 1, but produced with an alternative printing method. The dedicated press as schematically depicted in FIG. 5 is used in an alternative configuration, in which the magnetic orientation is performed using cylinder R. In this case, the ink layer containing magnetically orientable pigments is applied by the gravure printing unit G1 and is hardened as the web passes under the hot air (H1) and the UV (U1) dryer units. The ink is prepared according to formulation 2*b* given in example 2 of WO 2007/131833. An adequate gravure cylinder must be used in order to reach a typical dried ink thickness of 18 μm. The subsequent layers are applied in further steps using the gravure units G2 and G3.

The invention claimed is:

1. A method for producing a security thread or stripe for incorporation into or onto a value document or a currency substrate, comprising:

coating a plastic foil with a coating composition comprising optically variable magnetic or magnetizable pigment particles;

orienting the magnetic or magnetizable pigment particles to represent graphic information;

hardening the oriented magnetic or magnetizable pigment particles coating to fix the magnetic or magnetizable pigment particles in their respective positions and orientations; and slicing the plastic foil with the hardened into threads or stripes;

wherein the graphic information is produced with a magnetic orienting cylinder having a seamless and continuous repetitive magnetic field pattern having a repetition length.

2. The method according to claim 1, wherein the orienting of the magnetic or magnetizable particles comprises applying a structured magnetic field.

3. The method according to claim 1, further comprising applying an adhesive coating on at least one surface of the plastic foil.

4. The method according to claim 1, wherein the magnetic or magnetizable pigment particles are selected from the group consisting of optically variable magnetic thin-layer interference pigments.

5. The method according to claim 1, further comprising applying at least one separate coating layer including security materials selected from the group consisting of luminescent dyes and pigments, infrared-absorbing dyes and pigments, and metallic, magnetic, and interference pigments.

6. The method according to claim 1, further comprising applying a layer of micro-lenses or a holographic layer selected from volume holograms and metallized, demetallized, or partially demetallized (indicia) surface holograms.

7. The method according to claim 1, further comprising laminating a second plastic foil onto the coated plastic foil to produce a laminated structure, in which the hardened coating is located between the plastic foil and the second plastic foil.

8. The method according to claim 7, wherein the second plastic foil carries imprinting complementary to the graphic information on the coated plastic foil.

9. The method according to claim 1, wherein the coating is formed with a printing method selected from the group consisting of rotogravure printing using a seamless engraved printing cylinder, screen-printing using a seamless rotary screen, and flexographic printing using Anilox roller/doctor blade inking.

* * * * *